US009596731B1

(12) United States Patent
Lin

(10) Patent No.: US 9,596,731 B1
(45) Date of Patent: Mar. 14, 2017

(54) METHOD FOR MODULATING COLOR TEMPERATURE IN VISIBLE BAND

(71) Applicant: HM ELECTRONICS CO., LTD., Douliu, Yunlin County (TW)

(72) Inventor: Tsung-Ping Lin, Douliu (TW)

(73) Assignee: HM ELECTRONICS CO., LTD., Douliu, Yunlin County (TW)

( * ) Notice: Subject to any disclaimer, the term of this patent is extended or adjusted under 35 U.S.C. 154(b) by 0 days.

(21) Appl. No.: 14/859,769

(22) Filed: Sep. 21, 2015

(51) Int. Cl.
*H05B 33/08* (2006.01)

(52) U.S. Cl.
CPC ..... *H05B 33/086* (2013.01)

(58) Field of Classification Search
CPC ..... H05B 33/08
USPC ..... 315/297
See application file for complete search history.

(56) References Cited

U.S. PATENT DOCUMENTS

2004/0105261 A1* 6/2004 Ducharme ..... H05B 33/0863 362/231
2013/0002157 A1* 1/2013 Van De Ven ..... H05B 33/0824 315/192
2014/0035472 A1* 2/2014 Raj ..... H05B 33/0863 315/185 R

* cited by examiner

*Primary Examiner* — Don Le
(74) *Attorney, Agent, or Firm* — Muncy, Geissler, Olds & Lowe, P.C.

(57) ABSTRACT

A color temperature modulating method involves: computing blackbody spectrums including a target color temperature, and performing normalization at a benchmark wavelength to define a common color-temperature area; selecting a white LED containing phosphor; adjusting the white LED's intensity such that the primary-peak wavelength is close to a maximum relative intensity in the common color-temperature area accordingly; using a blue LED, a green LED, and at least two red LEDs, wherein peak wavelengths of the blue and green LEDs are located between the primary and the secondary wavelength of the white LED, and peak wavelengths of the red LEDs are greater than the primary-peak wavelength; and adjusting relative intensities of the blue, green, and red LEDs to make a relative intensity of a combination of these LEDs and the white LED close to the target color temperature.

9 Claims, 14 Drawing Sheets

METHOD FOR MODULATING COLOR TEMPERATURE IN VISIBLE BAND

BACKGROUND OF THE INVENTION

Technical Field

The present invention relates to methods for modulating color temperatures, and more particularly to a method that uses blackbody radiations as benchmarks to modulate LEDs to simulate specific color temperatures in the visible band, thereby producing light that has good color rendering property.

Description of Related Art

Traditionally, in an adjustable light-emitting device that modulates color temperatures using plural red, green and blue LEDs, adjustment of color temperature is usually achieved according to chromaticity coordinates or CRI (Color Rendering Index). However, the traditional red, green and blue LEDs usually have narrow spectral bandwidths, and there are only a few kinds of high-efficiency phosphor can work with them. Under the circumstances that only using three to five different wavelengths to modulate different color temperatures, it is difficult to achieve good color rendering property in different color temperatures.

The traditional method to compute CRI is that comparing with the reference to colors of reflected light of 14 different reference material under illumination from a subject light source. Although the application of CRI is getting more and more extensive, the conformity of the reference material has increasingly incurred doubts from experts in various fields. The key issue lies on metamerism that prevents the reference values of the all 14 different colors for CRI from meeting the requirements for good color rendering property at the same time. This may hinder CRI from accurately expressing the color rendering property of the object light source. Hence, there is a need for a method for modulating color temperatures that is accurate and independent of the reference or standard for CRI.

BRIEF SUMMARY OF THE INVENTION

In view of this, the primary objective of the present invention is to provide a method for modulating colors temperature in visible band, which express the color rendering property of a light source in visible band more accurately.

For achieving the foregoing objective, the present invention provides a method for modulating color temperatures in the visible band, which comprises the following steps: selecting a benchmark wavelength, and computing a plurality of blackbody spectrums for different color temperatures and performing normalization at the benchmark wavelength so as to define a common color-temperature area, wherein the blackbody spectrums include a target color temperature; selecting a white LED containing phosphor, wherein the white LED has a spectral curve including a primary-peak wavelength and a secondary-peak wavelength; adjusting the white LED in terms of a relative intensity so as to make a relative intensity of the primary-peak wavelength and a relative intensity of the secondary-peak wavelength close to maximums of the common color-temperature area corresponding to the relative intensities of the primary-peak wavelength and of the secondary-peak wavelength, respectively; using a first blue LED, a second blue LED, at least one green LED and at least two red LEDs, wherein peak wavelengths of spectral curves of the first blue LED, the second blue LED, and the at least one green LED are located between the primary-peak wavelength and the secondary-peak wavelength, and peak wavelengths of spectral curves of the at least two red LEDs are greater than the primary-peak wavelength; and adjusting relative intensities of the first blue LED, the second blue LED, the at least one green LED, and the at least two red LEDs, so as to make a relative intensity of a combination of these LEDs and the white LED close to the target color temperature.

Hence, the present invention takes blackbody spectrums as standard reference values to modulate color temperatures, allowing to modulate a light source to a target color temperature more accurately.

Preferably, in the present invention two blue LEDs, a green LED and two red LEDs are alternatively used. The peak wavelengths of the blue and green LEDs locate between the white LED's primary-peak wavelength and secondary-peak wavelength. The peak wavelengths of the red LEDs are greater than the white LED's primary-peak wavelength. Thus, even though LEDs' spectral bandwidths are usually narrow, it is still allowed to accurately modulate a color-temperature curve close to a target color temperature by adjusting the relative intensity of each of the LEDs.

DETAILED DESCRIPTION OF THE INVENTION

The invention as well as a preferred mode of use, further objectives and advantages thereof will be best understood by reference to the following detailed description of illustrative embodiments when read in conjunction with the accompanying drawings. In practical use, the implementation of the present invention involves using a computer to simulate a color-temperature curve first, and then adjusting individual LED in terms of luminous flux according to relative intensities of spectrums of components forming the abovesaid color-temperature curve, so as to make a light-emitting device having these LEDs emit light close to a target color temperature. The disclosed method for modulating color temperatures is described through the following steps in detail.

Figure 1:
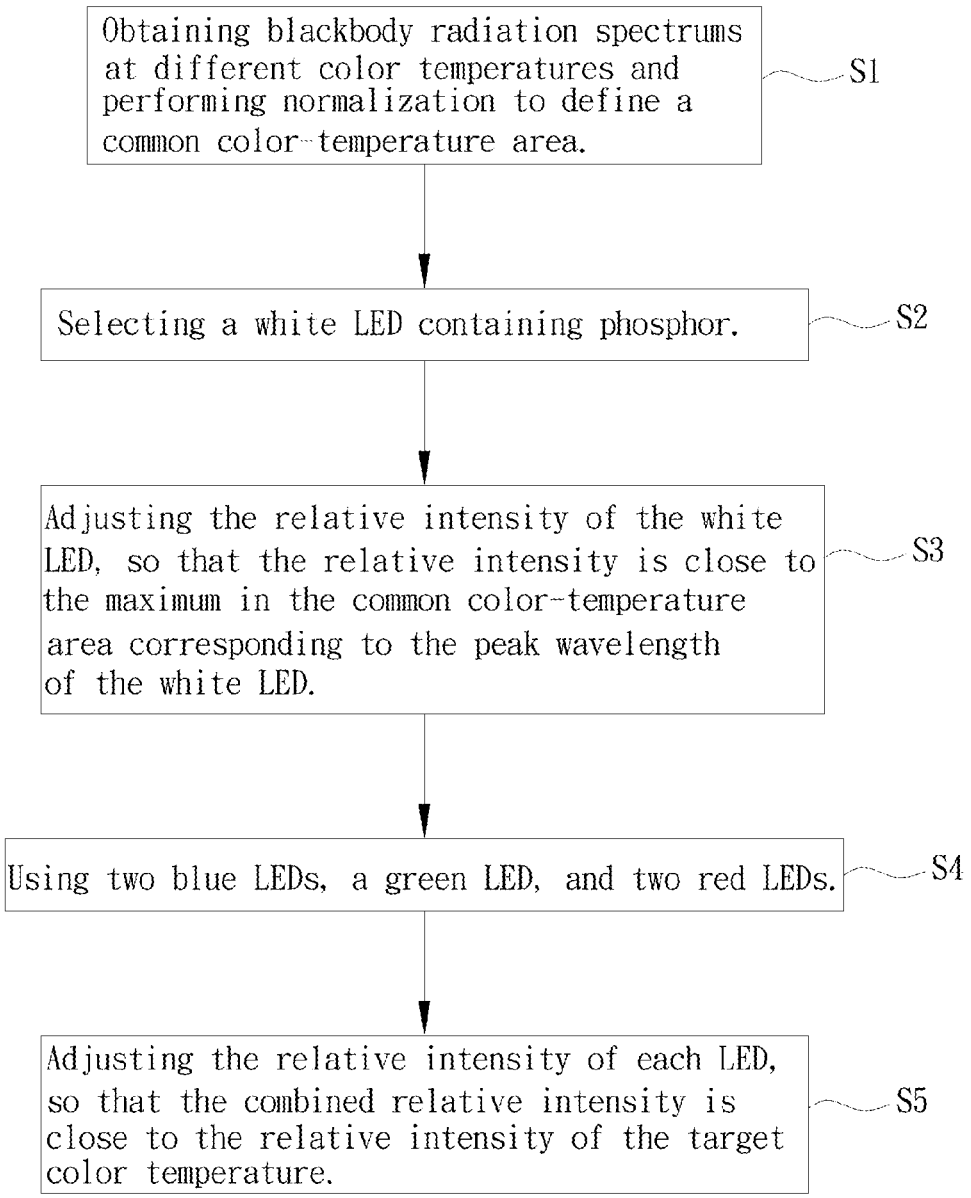
FIG. 1 is a flowchart of the method of the present invention.
Figure 2:
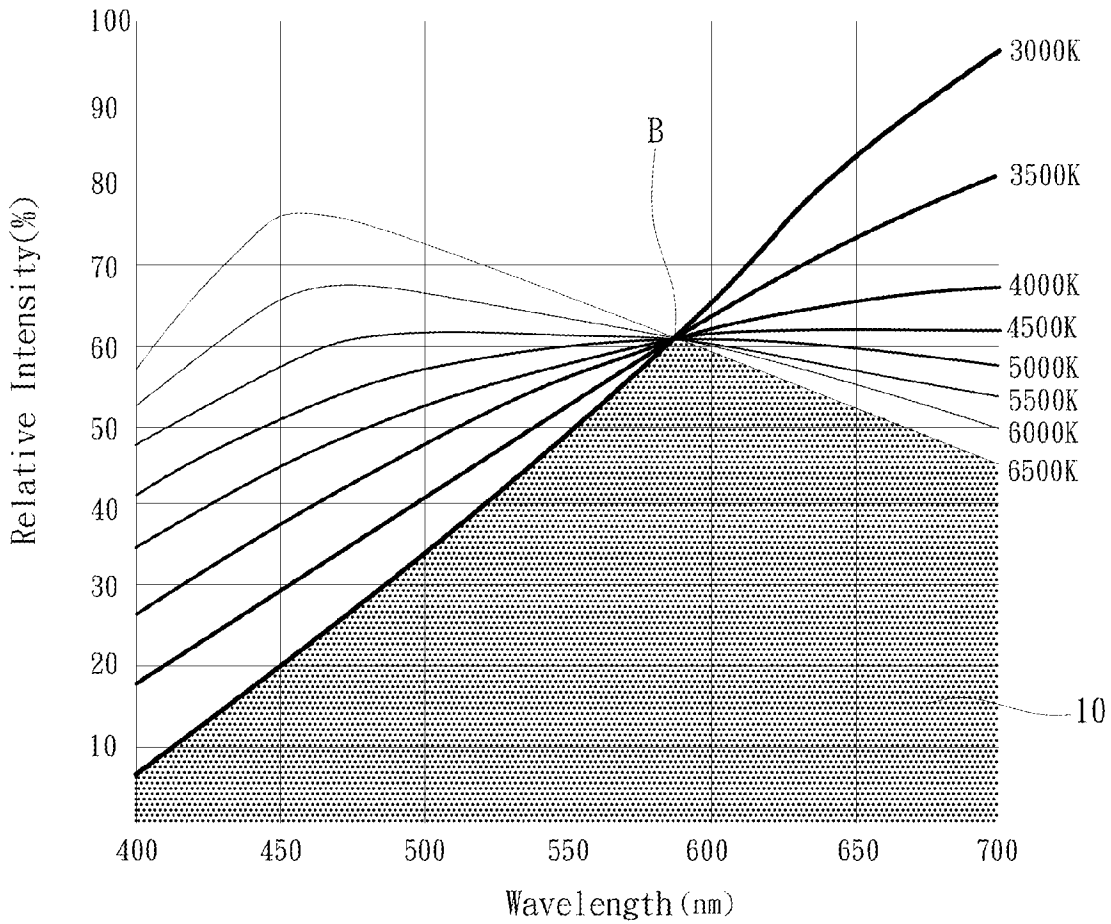
FIG. 2 is a spectrum diagram of computed blackbody radiation, showing normalization performed at 588 nm.

In Step S1, referring to FIG. 1 and FIG. 2, perfect blackbody radiation spectrums at different color temperatures are computed theoretically, and a benchmark wavelength B is selected. According to the benchmark wavelength B, the blackbody radiation spectrums of different color temperatures are normalized. For the clarity of illustration, only the wavelengths ranging between 400 nm and 700 nm in visible band are shown. In the present embodiment, the range for selecting the blackbody radiation spectrums is between Kelvin temperatures 3000K to 6500K. Eight blackbody radiation spectrums are taken with an interval of 500K therebetween. The selected benchmark wavelength B is 588 nm, and the computed spectral curves are shown in FIG. 2. The foresaid spectral curves include the target color temperature that the present embodiment aims to modulate: 3000K. As can be seen, each of the spectral curves includes a common color-temperature area 10 (shown in the dotted area at the lower part of the drawing). The common color-temperature area 10 refers to a spectral area that is included by every of the foresaid blackbody spectrums.

Figure 3:
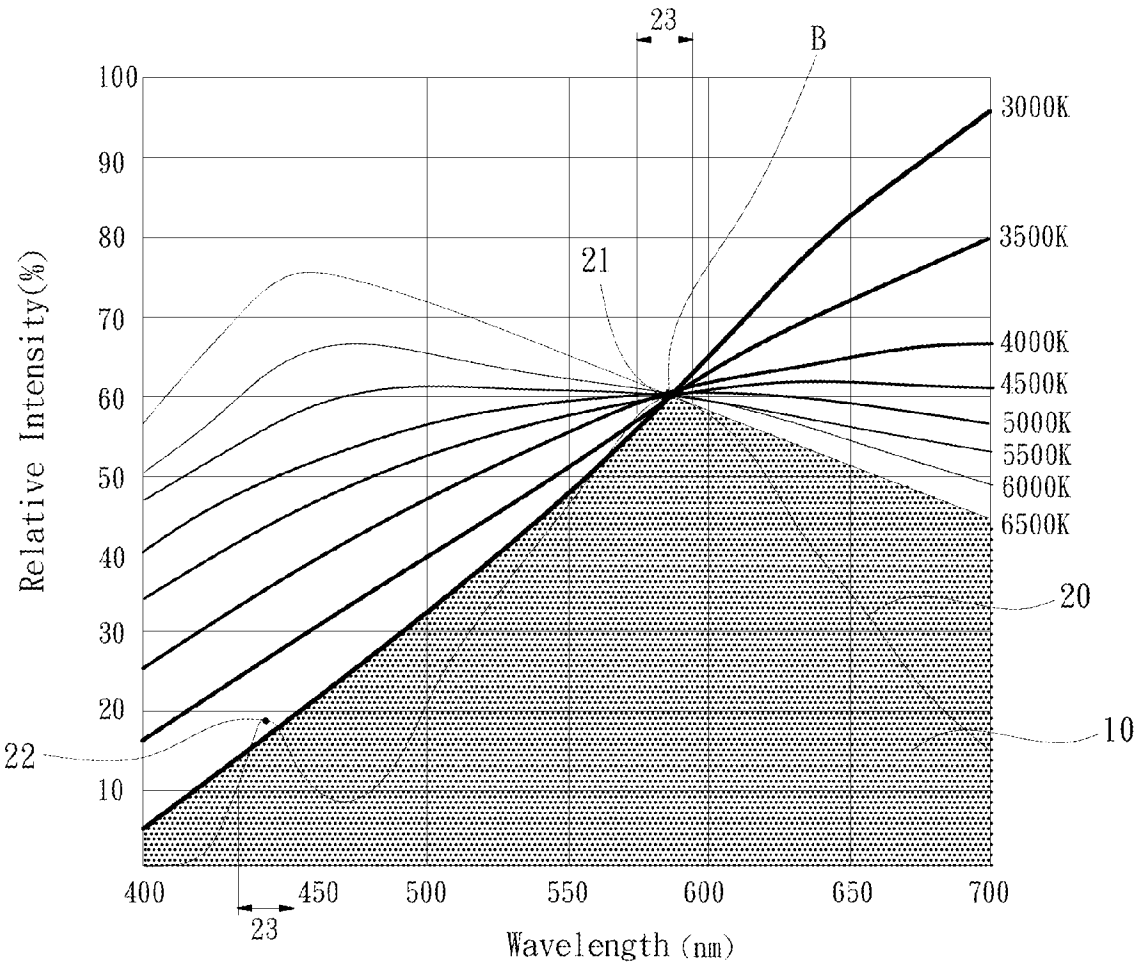
FIG. 3 is a spectrum diagram of a white LED.

In Step S2, a white LED containing phosphor is selected. This white LED has its spectral curve 20 as shown in FIG. 3. Generally, the white LED generates white light by using a blue LED to excite the phosphor. The spectral curve 20 includes a primary-peak wavelength 21 and a secondary-peak wavelength 22. The locations of the primary-peak wavelength 21 and the secondary-peak wavelength 22 may vary with the formulation of phosphor used in the LED. In the present embodiment, the selected primary-peak wavelength 21 is at 580 nm, and the secondary-peak wavelength 22 is at 440 nm. Also, in the present embodiment, the primary-peak wavelength 21 is such selected that it is as close to a range of ±5 nm from the benchmark wavelength B as possible.

It is to be noted that, since the options for high-efficiency phosphor for the white LED are limited, the method may be alternatively conducted by performing Step S2 (i.e. selecting the white LED) before Step S1. In this case, the benchmark wavelength B is selected to be close to or equal to the primary-peak wavelength 21, and normalization is then performed.

In Step S3, the white LED is adjusted in terms of relative intensity, so that the relative intensity of the primary-peak wavelength 21 is close to the maximum in the common color-temperature area 10 corresponding to the relative intensity of the primary-peak wavelength 21 (as shown in FIG. 3), and that the relative intensity of the secondary-peak wavelength 22 is close to the maximum in the common color-temperature area 10 corresponding to the relative intensity of the secondary-peak wavelength 22. In the present embodiment and other possible embodiments, where it refers to increasing (or decreasing) relative intensities of LEDs, it means to increase (or decrease) the luminous fluxes of the LEDs and the relative intensities among the LEDs by, for example, adjusting currents for the LEDs.

In Step S3, the so-called "being close to the primary-peak wavelength 21" means making a result of the relative intensity corresponding to a unit wavelength range 23 away from the primary-peak wavelength 21 minus the maximum in the common color-temperature area 10 corresponding to the relative intensity in the foresaid range smaller than a first threshold value. Similarly, the relative intensity in a unit wavelength range 23 away from the secondary-peak wavelength 22 may have the subtraction as the primary-peak wavelength 21 does, so as to make the computed result smaller than a second threshold value. However, it is to be noted that adjustment of the relative intensity of the primary-peak wavelength 21 also influence the relative intensity of the secondary-peak wavelength 22, meaning that the two are not independent to each other. The first threshold value and the second threshold value may be set otherwise. For example, the first threshold value may be set equal to the second threshold value. Alternatively, it is possible to consider the first threshold value only without considering the second threshold value. In the present embodiment, the unit wavelength ranges 23 for the primary-peak wavelength 21 (580 nm) and for the secondary-peak wavelength 22 (460 nm) are both set as ±20 nm. The first threshold value is set in the common color-temperature area 10, corresponding to +15% from the maximum of the relative intensity of the range between 560 nm and 600 nm. The second threshold is set in the common color-temperature area 10, corresponding to ±10% from the maximum of the relative intensity of the range between 440 nm and 480 nm.

It is also to be noted that for setting the first threshold, it is possible to merely compare the relative intensity of the primary-peak wavelength 21 and the maximum in the common color-temperature area 10 corresponding to the primary-peak wavelength 21, or to compute the integration value of the wavelength and the relative intensity within the unit wavelength range 23.

Figure 4:
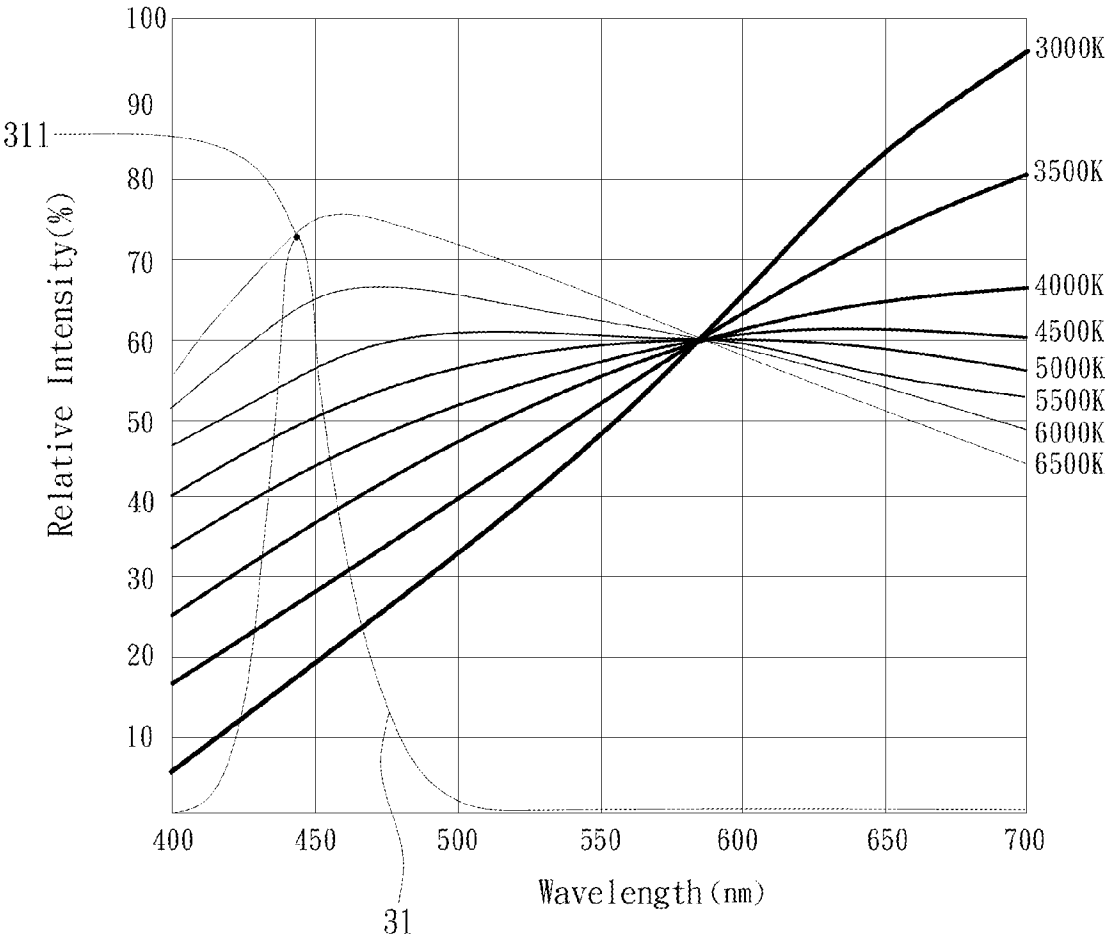
FIG. 4 is a spectrum diagram of a first blue LED.
Figure 5:
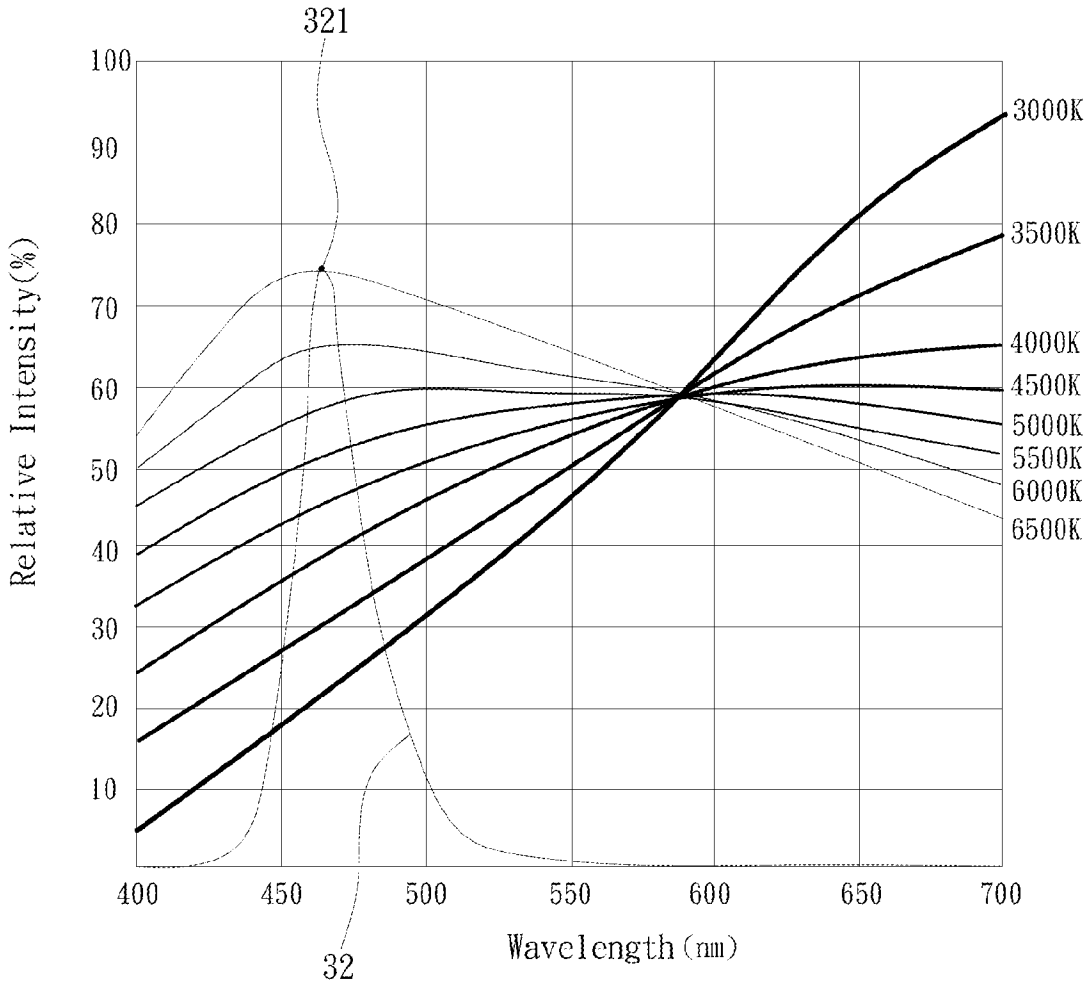
FIG. 5 is a spectrum diagram of a second blue LED.
Figure 6:
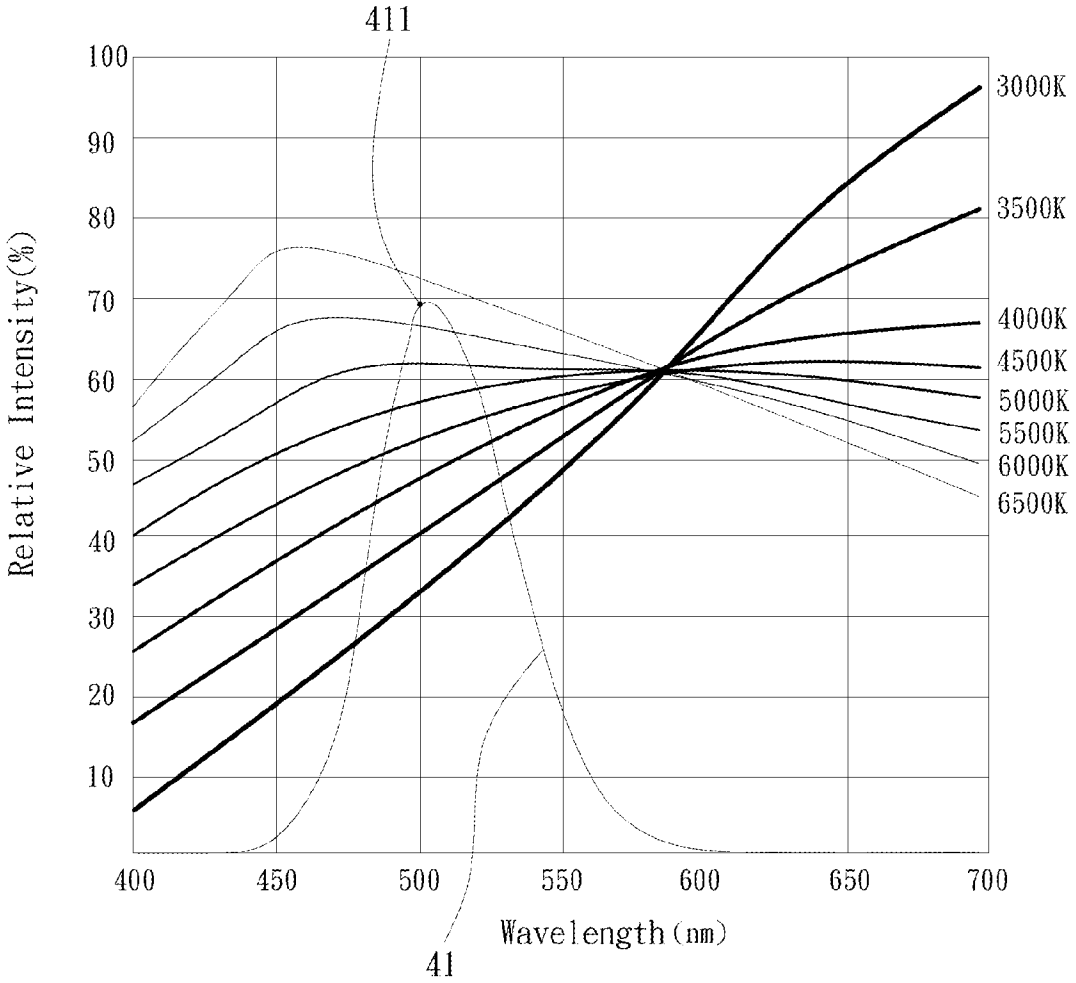
FIG. 6 is a spectrum diagram of a green LED.
Figure 7:
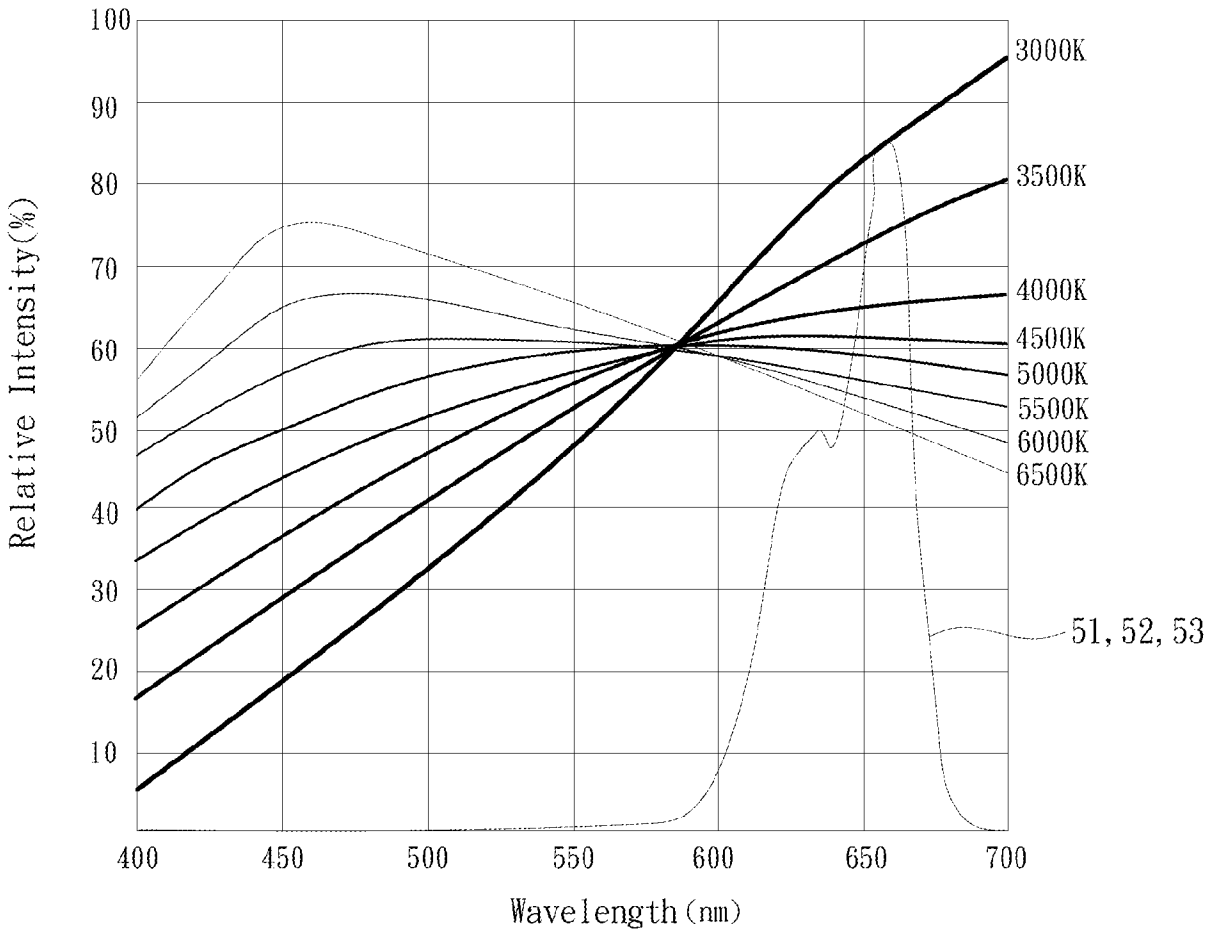
FIG. 7 is a combined spectrum diagram of the first, second, third red LEDs.

In Step S4, selecting a first blue LED, a second blue LED, at least one green LED and at least two red LEDs. In the present embodiment, the first blue LED has its spectral curve 31 including a peak wavelength 311 as 445 nm (as shown in FIG. 4), and the second blue LED has its spectral curve 32 including a peak wavelength 321 as 465 nm (as shown in FIG. 5), while the difference value between the peak wavelengths of the both is at least greater than 10 nm. Two green LEDs are used. One of the green LEDs has its spectral curve 41 including a peak wavelength 411 as 500 nm (as shown in FIG. 6), and the other green LED has its spectral curve including a peak wavelength as 525 nm. Moreover, three red LEDs are used (as shown in FIG. 7). Their spectral curves 51, 52, 53 have peak wavelengths 511, 521, 531 as 620 nm, 630 nm and 660 nm respectively. Therefore, the blue LEDs' spectral curves 31, 32 and the green LED's spectral curve 41 all have their peak wavelengths located between the primary-peak wavelength 21 and the secondary-peak wavelength 22, while the red LEDs' spectral curves 51, 52, 53 all have their peak wavelengths greater than the primary-peak wavelength 21.

Figure 8:
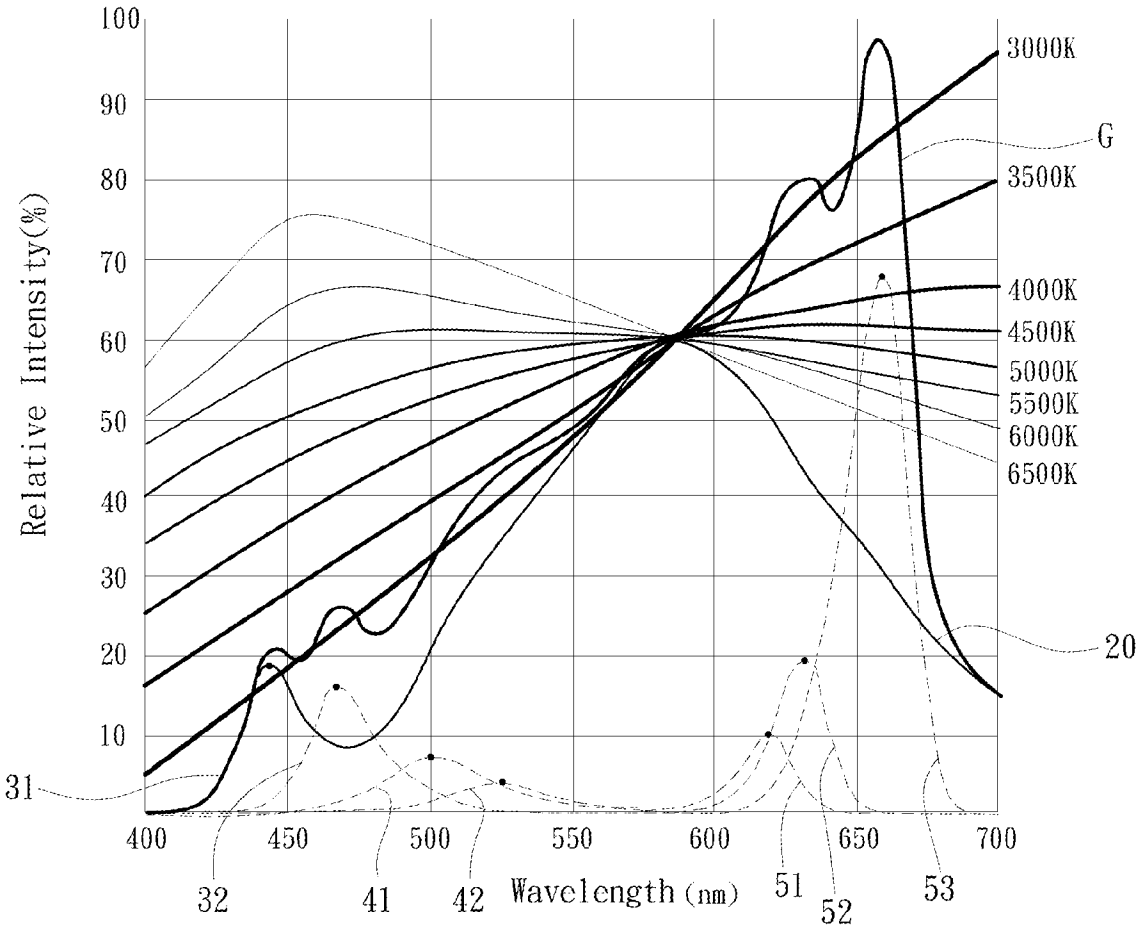
FIG. 8 is a spectrum diagram showing modulation performed according to a first embodiment of the present invention to a target color temperature of 3000K.

In Step S5, referring to FIG. 8, the red LEDs, green LEDs, blue LEDs are all adjusted in terms of relative intensity, so that the color-temperature curve G of the resultant relative intensity of the combination of the red LEDs, green LEDs, blue LEDs and the white LED is close to the target color temperature. In the present embodiment, the ratio between the relative intensities of the green LEDs having the peak wavelengths as 500 nm and 525 nm is 2:1. 1. The ratio among the relative intensities of the red LEDs having the peak wavelengths as 620 nm, 630 nm and 660 nm is 1:2:8. Then adjusting the LED's current and its corresponding luminous flux according to the abovesaid ratios of the LEDs' relative intensities, thus making the light-emitting device emit warm white light close to 3000K.

As shown in FIG. 8, the modulated color-temperature curve G in the band of visible light is very close to the curve of the blackbody spectrum of 3000K. Since the present embodiment takes blackbody spectrums as the standard reference values for modulating color temperatures, its conformity remains unchanged. Thus, the modulated color-temperature curve G can accurately and correctly express the color rendering property of the light, thus eliminate the abovesaid metamerism problem by using the 14 different reference materials, such that it causes inconsistent color rendering of different light source at the same CRI.

Figure 9:
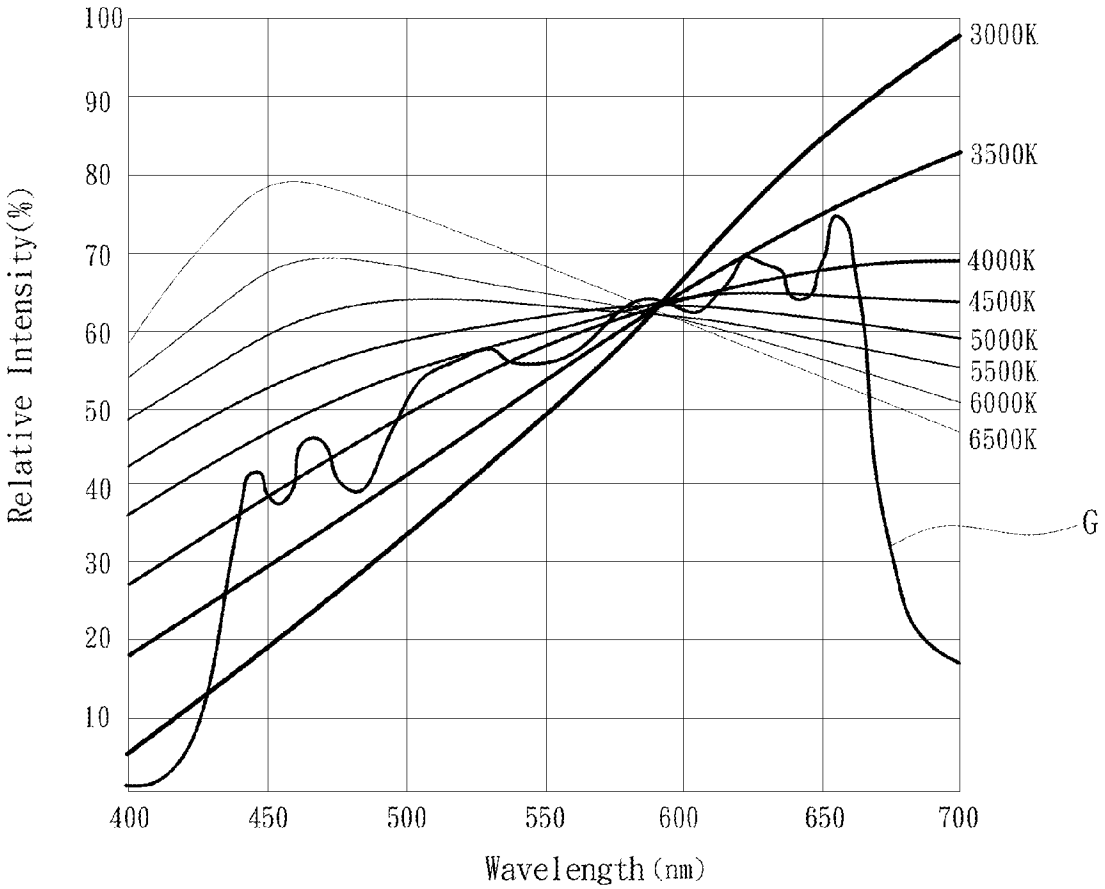
FIG. 9 is a spectrum diagram showing modulation performed according to the first embodiment of the present invention to a target color temperature of 4500K.
Figure 10:
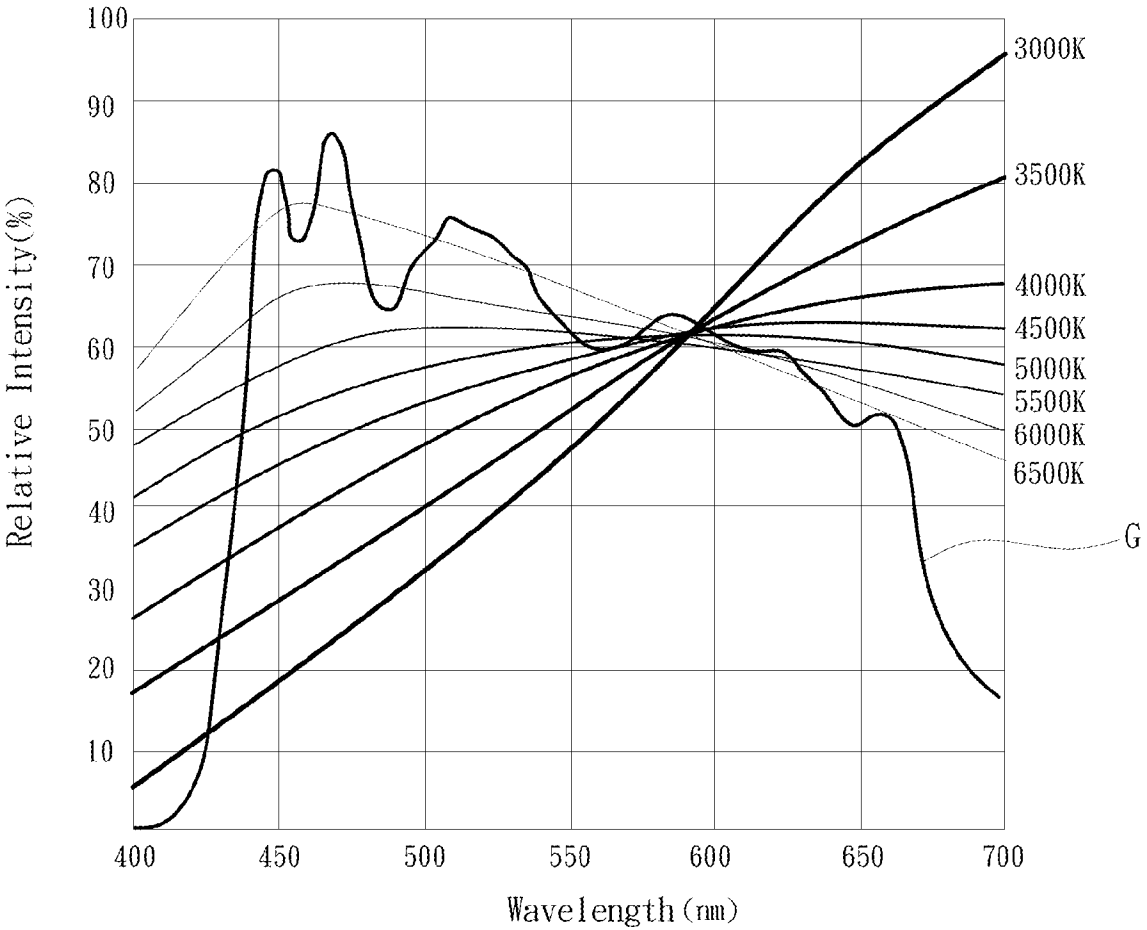
FIG. 10 is a spectrum diagram showing modulation performed according to the first embodiment of the present invention to a target color temperature of 6500K.

In addition, white, red, green, blue LEDs of the same quantity are used, with the target color temperature changed to 4000K, and the modulated color-temperature curve G is shown in FIG. 9. The modulated light is also very close to the target color temperature 4000K. When the target color temperature is changed to 6500K, the modulated color-temperature curve G is as shown in FIG. 10.

Figure 11:
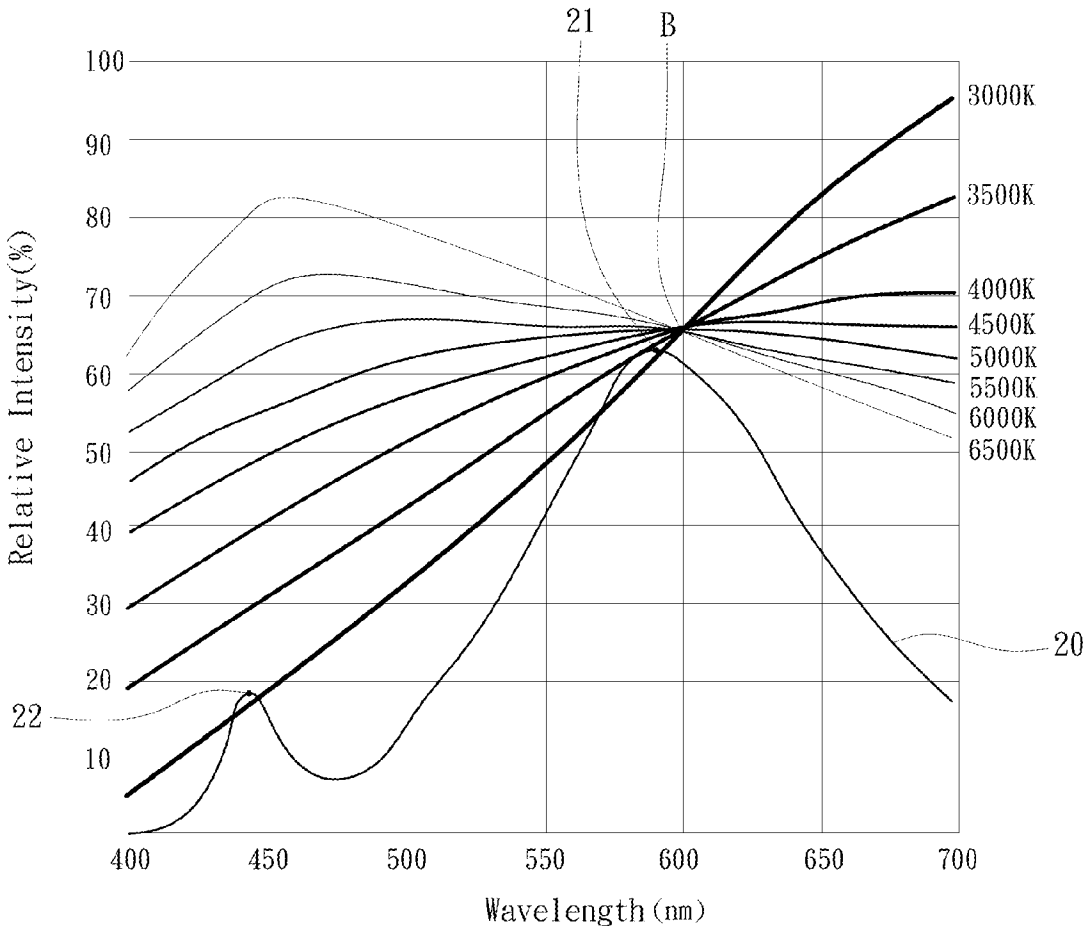
FIG. 11 is a spectrum diagram of computed blackbody radiation and a white LED, showing normalization performed at 600 nm.
Figure 12:
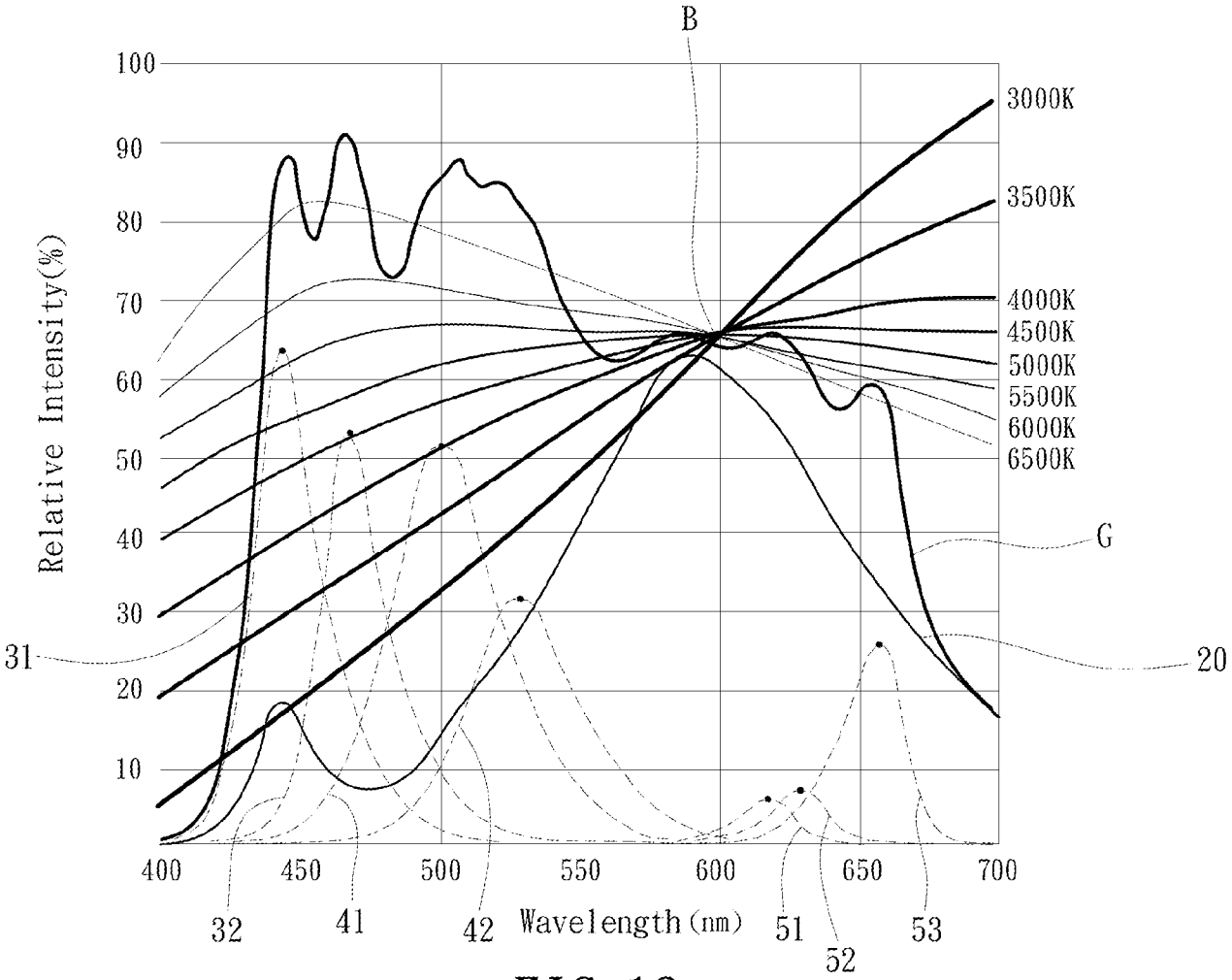
FIG. 12 is a spectrum diagram showing modulation performed according to a second embodiment of the present invention to a target color temperature of 6500K.

Based on the same concept, a second embodiment is provided, as illustrated in FIG. 11 and FIG. 12. Different from the first embodiment, the present embodiment has normalization performed at the benchmark wavelength B of 600 nm, and has the target color temperature set at 6500K. The primary-peak wavelength 21 in the spectral curve 20 of the white LED is also close to the benchmark wavelength B.

In addition, in Step S4, the selected blue, green and red LEDs are identical to those of the first embodiment in terms of quantity and peak wavelength, with the difference that the ratio of the relative intensities of the used two green LEDs (with peak wavelengths as 500 nm and 525 nm) is 5:3, and the ratio of the relative intensities of the used three red LEDs (peak wavelengths as 600 nm, 620 nm and 630 nm) is 4:5:22. The modulated color-temperature curve G is as shown in FIG. 12. It is very close to the target color temperature, 6500K, and thus the cold white light with a color temperature of 6500K can be accurately simulated.

Figure 13:
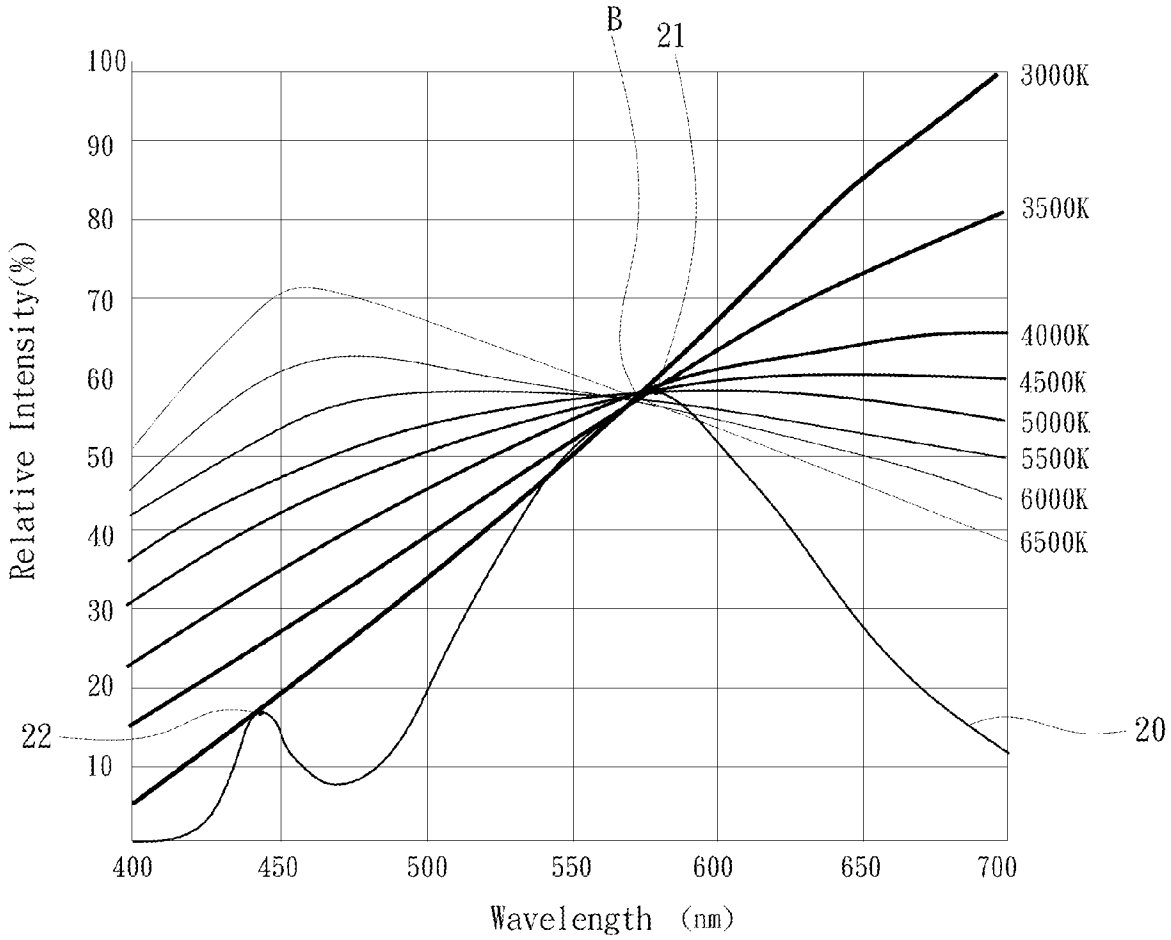
FIG. 13 is a spectrum diagram of computed blackbody radiation and a white LED, showing normalization performed at 570 nm.
Figure 14:
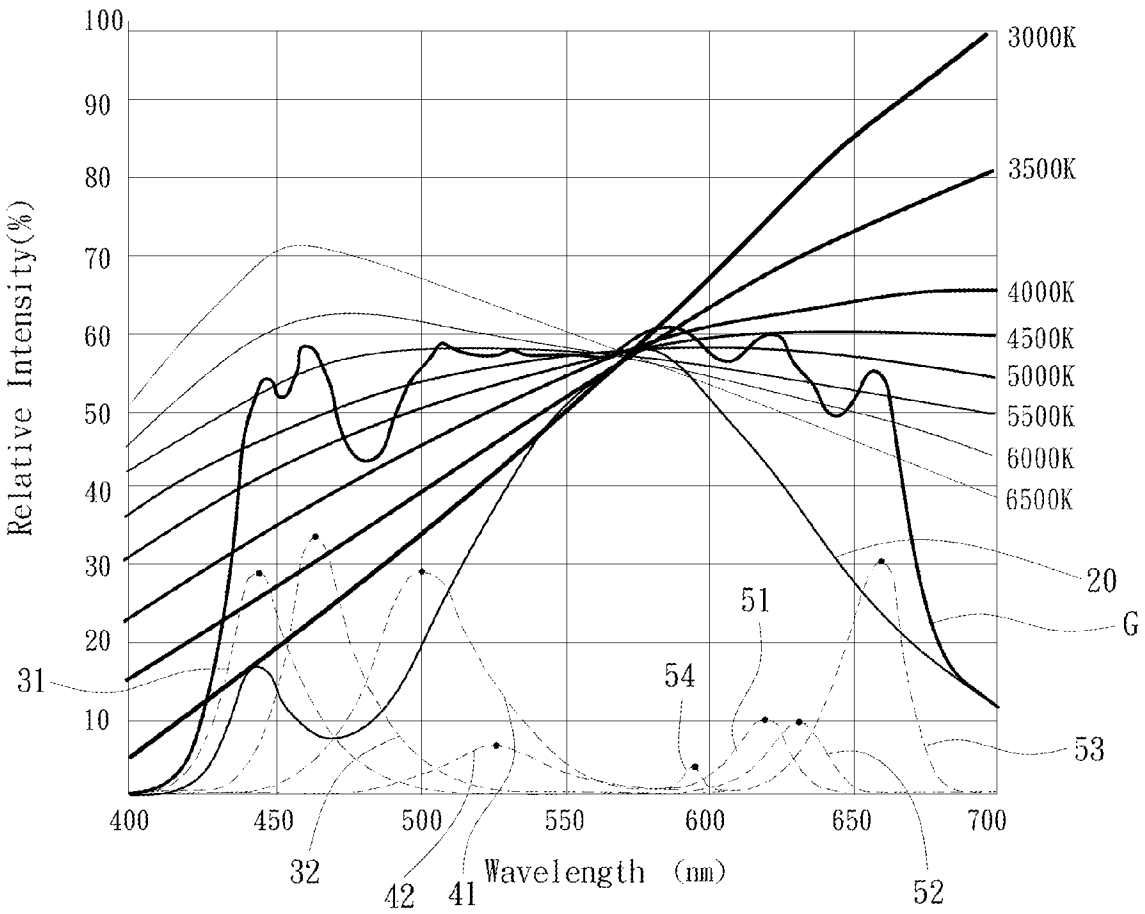
FIG. 14 is a spectrum diagram showing modulation performed according to a third embodiment of the present invention to a target color temperature of 5500K.

The present invention further provides a third embodiment. Referring to FIG. 13 and FIG. 14, the present embodiment has normalization performed at the benchmark wavelength B of 570 nm, and has the target color temperature set at 4000K. Also, the primary-peak wavelength 21 of the white LED peak wavelength 20 is close to the benchmark wavelength B (as shown in FIG. 13).

In a fourth embodiment, the selected blue and green LEDs are identical to those of the first embodiment in terms of quantity and peak wavelength, with the difference that four red LEDs are used, and the peak wavelengths in the red LEDs' spectral curve 51, 52, 53, 54 are 590 nm, 620 nm, 630 nm, and 660 nm respectively.

The two green LEDs (peak wavelengths at 500 nm and 525 nm) have a ratio between their relative intensities as 5:1, and the ratio of the relative intensities of the four red LEDs (peak wavelengths at 590, 600 nm, 620 nm and 630 nm) is 1:3:3:11. The modulated color-temperature curve G is as shown in FIG. 14, and is very close to the target color temperature, 4000K, therefore accurately simulating off-white light with the color temperature of 4000K.

It is to be noted that in each of the aforementioned embodiments, the quantity of the green LED may be reduced to one, and the quantity of the red LED may be reduced to two. In this case, the first blue LED, the second blue LED and the green LED can make up color shortage of the white LED at the range between its primary-peak wavelength 21 and secondary-peak wavelength 22, and the two red LEDs can make up color shortage of the white LED in visible band and at the range greater than the primary-peak wavelength 21, so as to make the modulated color-temperature curve G still accurately and correctly express the color rendering property.

The present invention has been described with reference to the preferred embodiments and it is understood that the embodiments are not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

What is claimed is:

1. A method for modulating color temperature in visible band, comprising the following steps:

selecting a benchmark wavelength, and computing a plurality of blackbody spectrums for different color temperatures and performing normalization at the benchmark wavelength so as to define a common color-temperature area, wherein the blackbody spectrums include a target color temperature;

selecting a white LED containing phosphor, wherein the white LED has a spectral curve including a primary-peak wavelength and a secondary-peak wavelength;

adjusting the white LED in terms of relative intensity so as to make a relative intensity of the primary-peak wavelength and a relative intensity of the secondary-peak wavelength close to maximums of the common color-temperature area corresponding to the relative intensities of the primary-peak wavelength and of the secondary-peak wavelength respectively;

using a first blue LED, a second blue LED, at least one green LED and at least two red LEDs, wherein peak wavelengths of spectral curves of the first blue LED, the second blue LED, and the at least one green LED are located between the primary-peak wavelength and the secondary-peak wavelength, and peak wavelengths of spectral curves of the at least two red LEDs are greater than the primary-peak wavelength; and adjusting relative intensities of the first blue LED, the second blue LED, the at least one green LED, and the at least two red LEDs, so as to make a color-temperature curve of a combination of these LEDs and the white LED close to the target color temperature.

2. The method of claim 1, wherein the selected benchmark wavelength is close to the primary-peak wavelength.

3. The method of claim 1, wherein a difference value between the peak wavelength of the first blue LED and the peak wavelength of the second blue LED is at least greater than 10 nm, and a difference value of the peak wavelengths of the at least two red LED is at least greater than 10 nm.

4. The method of claim 3, wherein the peak wavelength of the first blue LED is 445 nm, and the peak wavelength of the second blue LED is 465 nm.

5. The method of claim 1, wherein two green LEDs are used, and the two green LEDs have peak wavelengths thereof as 500 nm and 525 nm respectively.

6. The method of claim 3, wherein three red LEDs are used, and the red LEDs have peak wavelengths thereof as 620 nm, 630 nm and 660 nm, respectively.

7. The method of claim 3, wherein four red LEDs are used, and the red LEDs have peak wavelengths thereof as 590 nm, 620 nm, 630 nm and 660 nm, respectively.

8. The method of claim 1, wherein, a difference value between the relative intensity within a unit wavelength range of the primary-peak wavelength and a maximum relative intensity in the common color-temperature area corresponding to the unit wavelength range of the primary-peak wavelength is smaller than a first threshold value, and a difference value between the relative intensity within a unit wavelength range of the secondary-peak wavelength and a maximum relative intensity in the common color-temperature area corresponding to the unit wavelength range of the secondary-peak wavelength is smaller than a second threshold.

9. The method of claim 8, wherein the first threshold is ±10% of the maximum relative intensity of the common color-temperature area corresponding to the primary-peak wavelength, and the second threshold is ±15% of the maximum relative intensity of the common color-temperature area corresponding to the secondary-peak wavelength.

* * * * *